US005697446A

United States Patent [19]

Giannesini

[11] Patent Number: 5,697,446

[45] Date of Patent: Dec. 16, 1997

[54] METHOD AND SYSTEM FOR PRODUCING HYDROCARBONS FROM A TENSION-LEG PLATFORM

[75] Inventor: Jean-François Giannesini, Saint Cloud, France

[73] Assignee: Institut Francais Du Petrole, Rueil-Malmaison, France

[21] Appl. No.: 558,696

[22] Filed: Nov. 14, 1995

[30] Foreign Application Priority Data

Nov. 14, 1994 [FR] France ..... 94/13.678

[51] Int. Cl.[6] ..... E21B 7/128

[52] U.S. Cl. ..... 166/354; 166/358

[58] Field of Search ..... 166/354, 356, 166/357, 366, 367, 368; 114/230

[56] References Cited

U.S. PATENT DOCUMENTS

| | | | |
|---|---|---|---|
| 3,115,933 | 12/1963 | Haeber | 166/354 X |
| 3,163,224 | 12/1964 | Haeber et al. | 166/354 X |
| 3,189,093 | 6/1965 | Vries | 166/358 X |
| 3,871,184 | 3/1975 | Schirtzinger | 166/358 X |
| 3,983,706 | 10/1976 | Kalinowski | 166/355 X |
| 4,305,468 | 12/1981 | Goldsmith | 166/354 X |
| 4,913,238 | 4/1990 | Danazcko et al. | 166/358 X |
| 5,226,482 | 7/1993 | Giannesini et al. | 166/353 |
| 5,526,882 | 6/1996 | Parks et al. | 166/358 X |

*Primary Examiner*—Frank Tsay

*Attorney, Agent, or Firm*—Millen, White, Zelano, & Branigan, P.C.

[57] ABSTRACT

The present invention relates to a method and to a system for producing hydrocarbons from marginal offshore fields. The invention includes a baseplate (2) fastened to the bottom and a small-size floating support (9) anchored to the baseplate by tendons (10). The baseplate comprises locations (31) for wellheads (7,8) and at least one receptacle (22,32) for a pumping device (21). The floating support comprises hoisting device allowing workover operations in the wells and maintenance operations on the pumping device to be performed.

18 Claims, 5 Drawing Sheets

METHOD AND SYSTEM FOR PRODUCING HYDROCARBONS FROM A TENSION-LEG PLATFORM

FIELD OF THE INVENTION

The present invention relates to a system for producing hydrocarbons from a series of offshore wells preferably drilled through a great water depth, for example more than 300 meters of water.

The invention more specifically relates to the development of marginal offshore fields for which profitability can only be obtained with reduced infrastructure, installation and maintenance costs.

BACKGROUND OF THE INVENTION

Document U.S. Pat. No. 5,226,482 describes a method for developing offshore marginal fields. But this method, based on a floating multiphase pumping station, imposes the use of transfer means (for example a dynamic riser) for transferring the effluents produced by wells provided with subsea wellheads to the floating station. Furthermore, workover operations in wells, which are frequent during the life of a field, can only be performed with the mobilization of a floating support (boat, semisubmersible or tender) above each well. The same applies to the repairs or tests on the wellhead valves or the distribution pipes (manifolds).

Tension-leg floating structures (TLP or Tension-Leg Platform) are well-known, which consist of a foundation fastened to the sea bottom and of a floating support anchored by tendons fastened on one side to the foundation and on the other side to the support, so as to substantially limit the heave of the support. Risers connect the wells to the production deck located on the support for transferring the effluent to the surface. After processing the effluent, the production fluids are dispatched to a storage facility or to another platform.

This type of installation is complex because of all the different control and processing equipments that are to be set on the deck. In fact, space requirements impose larger structures, and therefore greater weights that impose notably more sophisticated anchor means. This type of installation is not suited to the development of marginal fields.

It appears that, in certain offshore field development patterns, it is not economical to invest in a heavy infrastructure, for example a fixed or a tension-leg platform, suited to be used for the complete well drilling program, for the processing, the storage and the transportation of effluents, or maintenance operations on well equipments.

In this case, one favors the pattern implementing production from wells provided with subsea wellheads, connected to a remote production installation. However, the wells must then be drilled by a semisubmersible or a drillship whose immobilization is costly. The same applies when workover operations are necessary, either on the subsea production wellheads, or in the wells for tests, cleaning operations or other operations grouped under the conventional denomination of "workover". In some wells, these operations can be frequent, which practically requires a nearly permanent access to the wells.

SUMMARY OF THE INVENTION

The object of the present invention is notably to propose an intermediate installation pattern in relation to the previous ones, by using notably a light tension-leg platform dimensioned only for operations such as bringing in, well workover, production testing, maintenance of wellhead controls or manifolds, and operating and maintenance of a preferably multiphase pumping device. What is understood to be bringing in operations also refers to light slim-hole drilling operations in or close to the producing formation. These operations do not require the implementation of heavy loads, so that the load-carrying ability of the floating support can be low and its size can therefore be reduced. Moreover, the tendons that provide the vertical and lateral stability of the support are tautened at reasonable values, which allows the present pattern to be used in greater water depths. One of the advantages of such a tension-leg platform (TLP) is that the workover operations or the subsea connections are facilitated, therefore less costly, owing to the nearly total absence of heave.

The present invention thus relates to a method for developing offshore oil fields that comprises the stages as follows:

- a baseplate comprising tendon fastening means, subsea wellhead locations, and pumping device receptacles is anchored to the sea bottom,
- a complementary floating support comprising hoisting means is set substantially straight above said baseplate,
- said tendons are fastened to said fastening means and to said complementary support and a predetermined tension is applied onto said tendons,
- at least one pumping device is lowered through the water depth with the aid of said hoisting means and connected onto said receptacles,
- said wellheads are connected to the pumping device by effluents collection and distribution means,
- the effluents coming out of the pumping device are transferred towards a process and/or a storage facility through a subsea line without transitting through said support.

At least one of the wellheads can be equipped with a riser running up to the complementary support.

At least part of the effluent of a well can be transferred to the complementary support to serve as fuel for the power generation means.

The power, measurements and commands transmission means between the support and the pumping device can be placed in a riser connecting the support to one of said locations free of wellheads.

The wells can be drilled from said locations of said baseplate by a floating drill support.

Workover operations can be performed in producing wells with the aid of the hoisting means of said complementary support, said wells being connected to said complementary support by a riser.

The invention further relates to a system for developing offshore oil fields comprising:

- a baseplate anchored to the sea bottom comprising tendon fastening means, subsea wellhead locations and pumping device receptacles,
- a complementary floating support placed substantially straight above said baseplate, comprising hoisting means,
- said tendons are fastened to said fastening means and to said complementary support, and tautened by a predetermined value,
- at least one pumping device suited for being operated through the water depth by means of said hoisting means and connected to one of said receptacles,
- effluent collection and distribution means connecting said wellheads to the pumping device, subsea transfer means for transferring the effluents coming from the pumping device towards process and/or storage facilities.

At least one of the wellheads can comprise a riser running up to the complementary support.

Said complementary support can comprise power generation means whose fuel comes from at least part of the effluent transferred to the complementary support.

The means for transmitting power, measurements and commands between the support and the pumping device can be located in a riser connecting the support to one of said locations free of wellheads.

The baseplate can have substantially the shape of a regular polygon, said means for fastening the tendons being placed substantially at the vertices of said polygon, said subsea wellhead locations being placed substantially between said vertices, and the receptacles of the pumping device can be placed substantially in the central part of said polygon.

The baseplate and the complementary support can have a substantially square external shape with sides of about 30 meters.

Said pumping device can comprise a multiphase pump, a motor, a multiphase flow indicating module and a regulation module.

BRIEF DESCRIPTION OF THE DRAWINGS

Other features and advantages of the present invention will be clear from reading the description hereafter of embodiments given by way of non limitative examples, with reference to the accompanying drawings in which.

DESCRIPTION OF THE PREFERRED EMBODIMENTS

Figure 1:
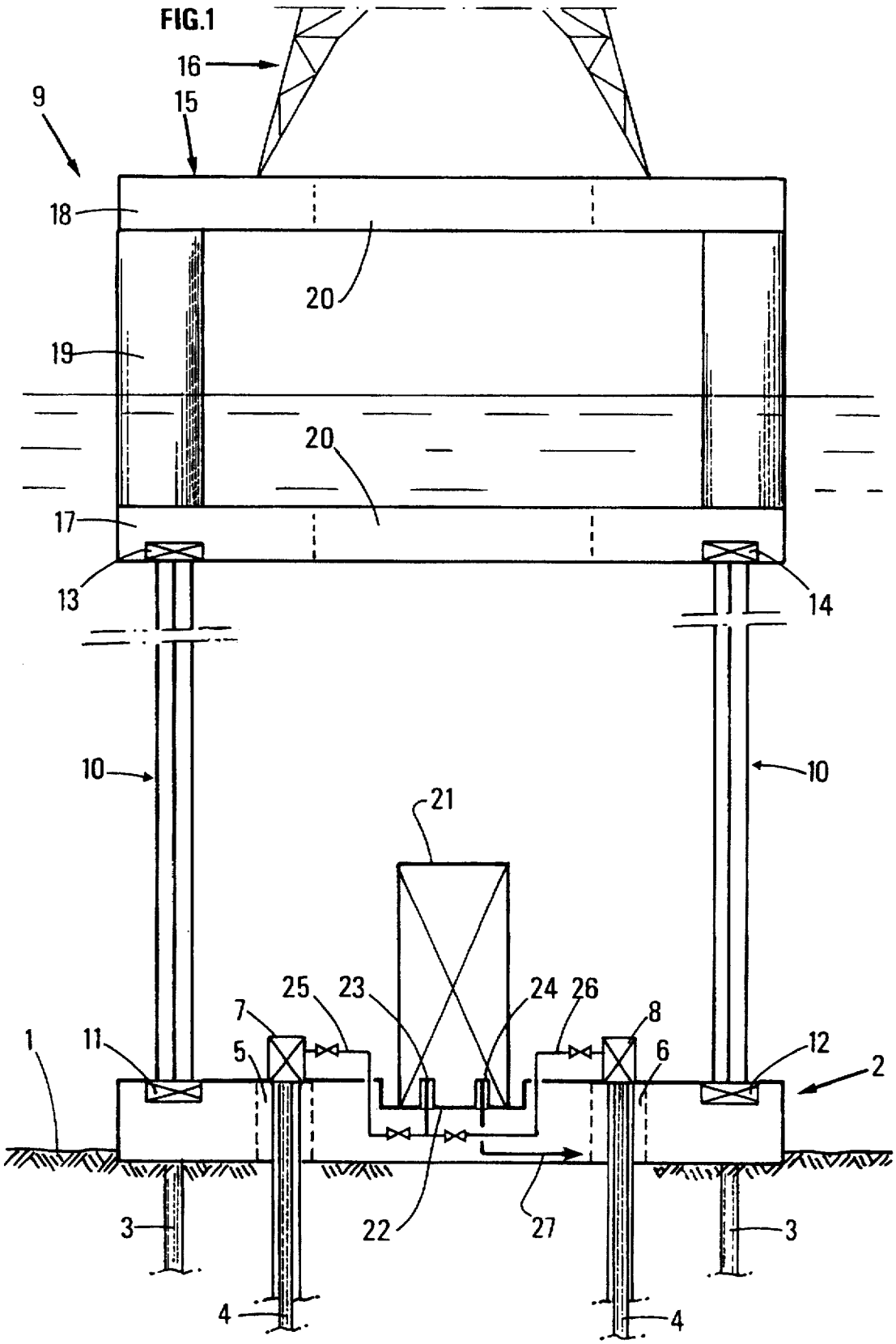
FIG. 1 diagrammatically illustrates a preferred embodiment of the invention.

FIG. 1 diagrammatically shows an example that illustrates the principle of the present invention. A baseplate 2 lies on the sea bottom 1 and is fastened by piles 3.

Figure 2:
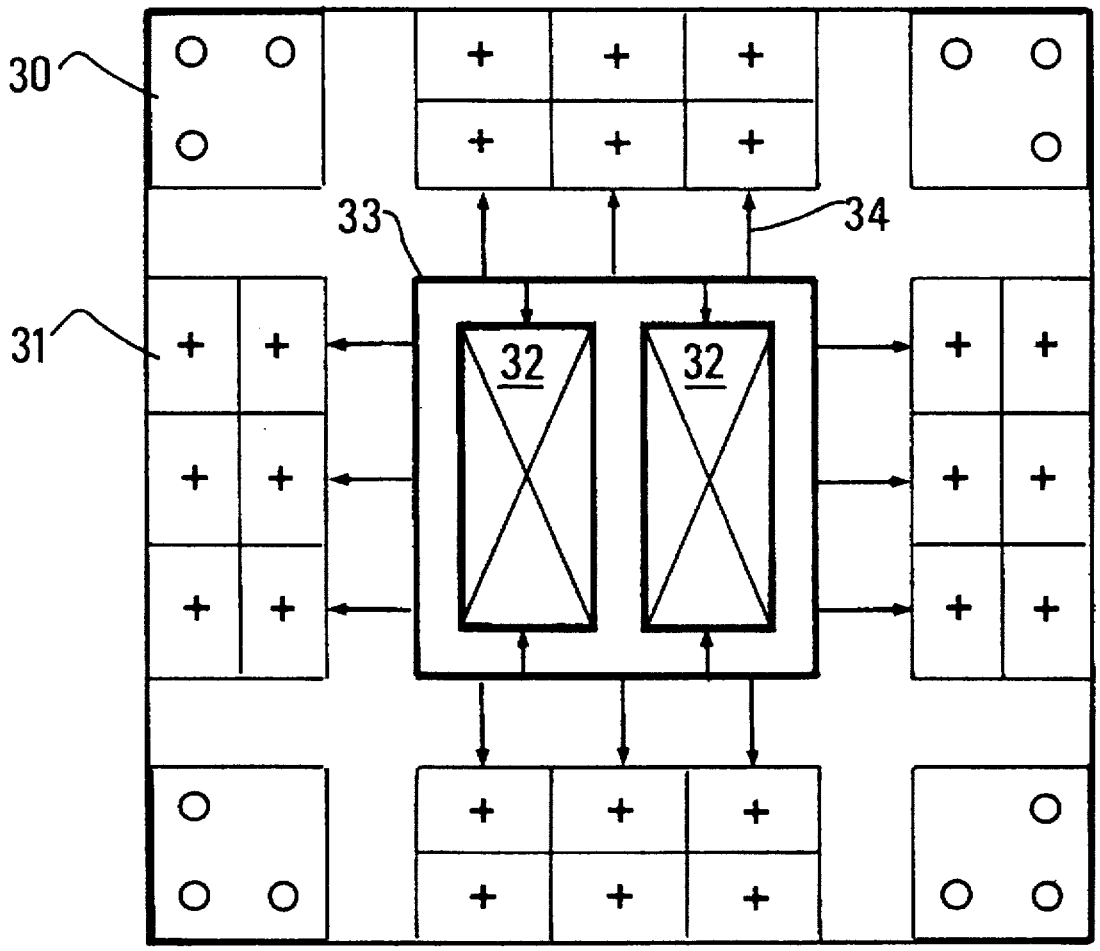
FIG. 2 diagrammatically shows a topview of a baseplate according to the preferred embodiment, FIG. 3 diagrammatically shows the connections between producing wells and a pumping device, FIG. 4 diagrammatically shows a variant for power production and the surface/bottom connection of the commands, and means for the transportation of the power necessary for the pumping device.

Wells 4 have been drilled from the locations 5 and 6 provided in the structure of baseplate 2. These locations are called slots in the profession. A baseplate can have a certain number of slots which will be all or partly used for drilling wells therein and for placing the wellheads 7 and 8, drilling heads during drilling operations, then production wellheads (Christmas tree) after the wells have been completed. FIG. 2 shows an example of arrangement of the slots.

In FIG. 1, a support 9 is placed substantially straight above the baseplate and it is connected to said baseplate by a series of tendons 10 fastened on one side to the baseplate by fastening means 11 and 12 and on the other side to fastening and/or tensioning means 13 and 14. Tendons 10 generally consist of elements screwed onto one another for crossing the water depth. Conventional tubulars can be advantageously used as tendon elements, for example casings of nominal size 11¾ (according to API standards).

Tendons 10 can be tautened by hydraulic or mechanical means located in the structure of the support 9, also called a platform. Thanks to the lightness of the support, the tension of the tendons is here preferably adjusted through the ballasting or the deballasting of caissons placed at the level of the pontoon 17. The tensions applied onto the tendons are determined as a function of the load-carrying ability of the platform, a load that is subject to variations on account of the various operations that can be performed from the floor 15, notably the shifting of loads by the hoisting means 16.

It can be noted that the heavier the loads on the platform are, the greater the displacement of the platform must be, and the more the tensioning lines must be mechanically resistant for applying a great tension in order to limit the motions of the platform as a function of the waves, current, winds, tide.

In the present example, the baseplate has a square shape with sides of about 30 meters. The platform substantially has the same size, but it consists of two pontoons 17 and 18 connected by columns 19 whose height is so determined that the floor 15 is out of water when the lower pontoon 17 is submerged.

A recess 20 is provided in the two pontoons so that the hoisting device can lower loads substantially in the central part of the platform in the direction of the baseplate.

For a water depth of 1000 meters, the following dimension characteristics can be given by way of example for the platform:

External dimensions of the pontoons 17 and 18 and of the baseplate 2: a square with sides of 25 to 40 meters, preferably about 30 meters.

Height of columns 19: between 15 and 30 meters, preferably about 20 meters.

Height of the pontoons: between 5 and 10 meters, preferably about 7 meters.

Weight of the structure: between 1200 and 3500 tons, preferably about 1500 tons.

Maximum tension of the tendons: about 300 tons.

A platform of this size and of this weight, subjected to wind, wave and current forces, requires no specific mechanical element for the connections with the sea bottom, be it for the tendons or possibly the risers. In fact, API standardized conventional tubes can be used, for example 11¾ for the tendons and 9⅝ for the risers.

The hoisting device 16 conventionally rests on girders that serve as rails allowing the hoisting device to be shifted on the deck along two orthogonal axes in order to adjust the verticality of the hoisting device straight above the objective. The hoisting device is not dimensioned for performing heavy drilling operations, but only for workover operations prior to the bringing in of wells, tests or maintenance operations in producing wells. If need be, a technical assistance craft can be set close to the platform according to the invention, the craft bearing the complementary facilities that cannot be present on deck 15, tube stocks or consumables.

A pumping device 21 placed in a marine-adapted caisson is connected to a receptacle 22 provided in baseplate 2. The device is thus located substantially under the recess 20, facilitating thereby the handling of device 21 by the hoisting means 16.

Connection means 23 and 24 consist of male and female elements that cooperate by fitting into each other when device 21 is placed in receptacle 22.

For example, the connection means 23 communicate with the pipes 25 and 26 delivering the effluent of the production wells to the pumping device. The connection means 24 communicate with the pipe 27 for carrying off the effluent discharged by the pumping device towards a process facility. Of course, the receptacle can be equipped with other connection means, notably for power, measurement and command transfers. If necessary, pipes 25, 26, 27 and the elements of the connection means 23 and 24 placed on receptacle 22 can be repaired or dismounted by remotely-controlled underwater robots according to methods and devices known in the profession.

FIG. 2 is a topview of the arrangement of the fastening means 30, of the wellhead slots 31 shown by a cross centered in a square and of the receptacles 22 for two pumping devices. The tendons are fastened to the four corners of the square with sides of about 30 meters. The slots are arranged along the sides, between two consecutive fastening means 30. In the present example, there are 6 slots per side, therefore 24 in all. The distance between each well is about 3.35 meters (11 feet) according to the current standard.

Line 33 and arrows 34 symbolize the manifold connecting all the wellheads to the pumping devices. As it is known in the profession, the manifold includes a series of tubes and of valves allowing to select one or several sources of the effluent for feeding the pumping device or devices.

The central position of the pumping devices allows their setting or their lifting by the hoisting device of the platform to be facilitated. Without departing from the scope of the present invention, instead of having a central position, the pumping device 21 and the receptacle 32 can be off-center on one side so as to leave room on deck 15 for an auxiliary facility, for example the power production means.

The preferred arrangement of the wellheads substantially on the periphery of the baseplate is advantageous because, in the case where one or several wellheads are extended up to the surface by a riser, this riser, suspended from the platform and preferably fastened at least transversely at the level of the lower pontoons 17, follows the lateral motions of the platform substantially parallel to the tendons. The riser thus undergoes substantially the same deformations and elongations as the tendons. It is not necessary to have an elongation compensation device at the top of the risers that are possibly present.

Of course, without departing from the scope of the present invention, the baseplate can have a polygonal shape other than square, comprising an equivalent arrangement pattern concerning the slots, the receptacles and the means for fastening the tendons. Certain sides of the baseplate may not be provided with slots.

Figure 3:
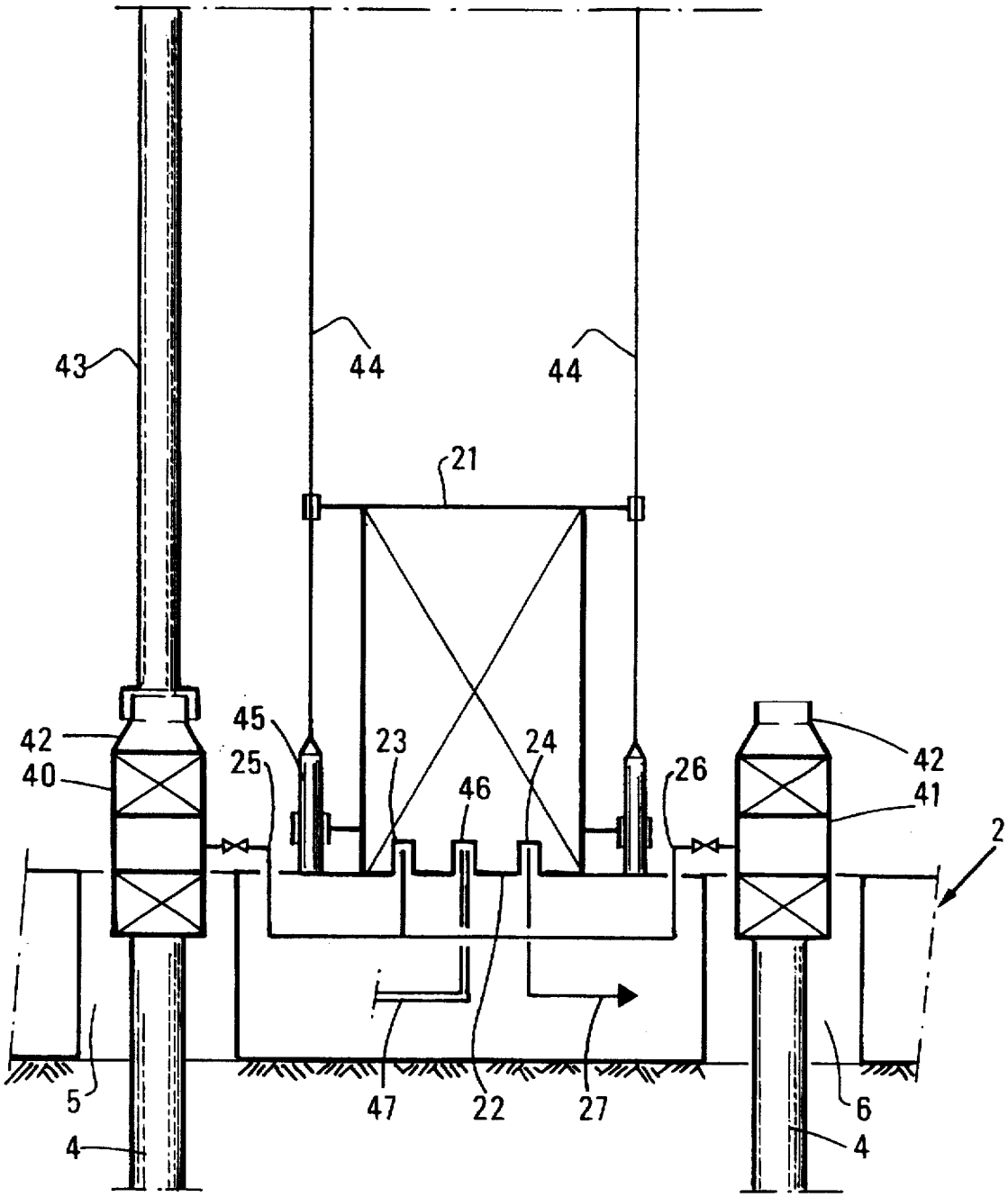

FIG. 3 shows more precisely the arrangement of the wells 4 placed in the slots 5 and 6 and equipped with wellheads 40 and 41. The wellheads comprise means 42 for connection with the lower end of a riser 43 extending up to the platform. Workover operations in wells 4 can be easily performed by means of the guidance provided by riser 43. The production platform can comprise a single riser 43 that will be shifted on the wellhead through which workover operations are to be carried out.

In some cases, all of the wells will be extended to the surface by risers.

The pumping device 21 is guided by guidelines 44 for connecting or lifting operations and properly centered and oriented on receptacle 22 by hinge pins 45.

In comparison with FIG. 1, a third connection means 46 is shown in FIG. 3 to schematize the principle of the connection means used for supplying the pumping device with power and for transmitting the various measurements and commands. Line 47 is connected to an umbilical that runs up to the platform, either directly in the water or according to the variant described in FIG. 4.

The pumping device 21 can comprise a multiphase pump such as that described in documents FR-2,333,139 and FR-2,471,501, equipped with a regulating surge tank and with the various components necessary for operation. The present invention is particularly well-suited when applied to offshore marginal fields under a relatively great water depth, i.e. at least 300 meters in the North Sea and generally deeper in sites where the waters are milder. These marginal fields are preferably brought into production by means of multiphase pumping that simplifies the production pattern, but that also imposes a special maintenance for the underwater pumping device. The arrangement given here by way of example shows that the platform allows easy and cheap workover operations to be performed notably on the pumping device.

Figure 4:
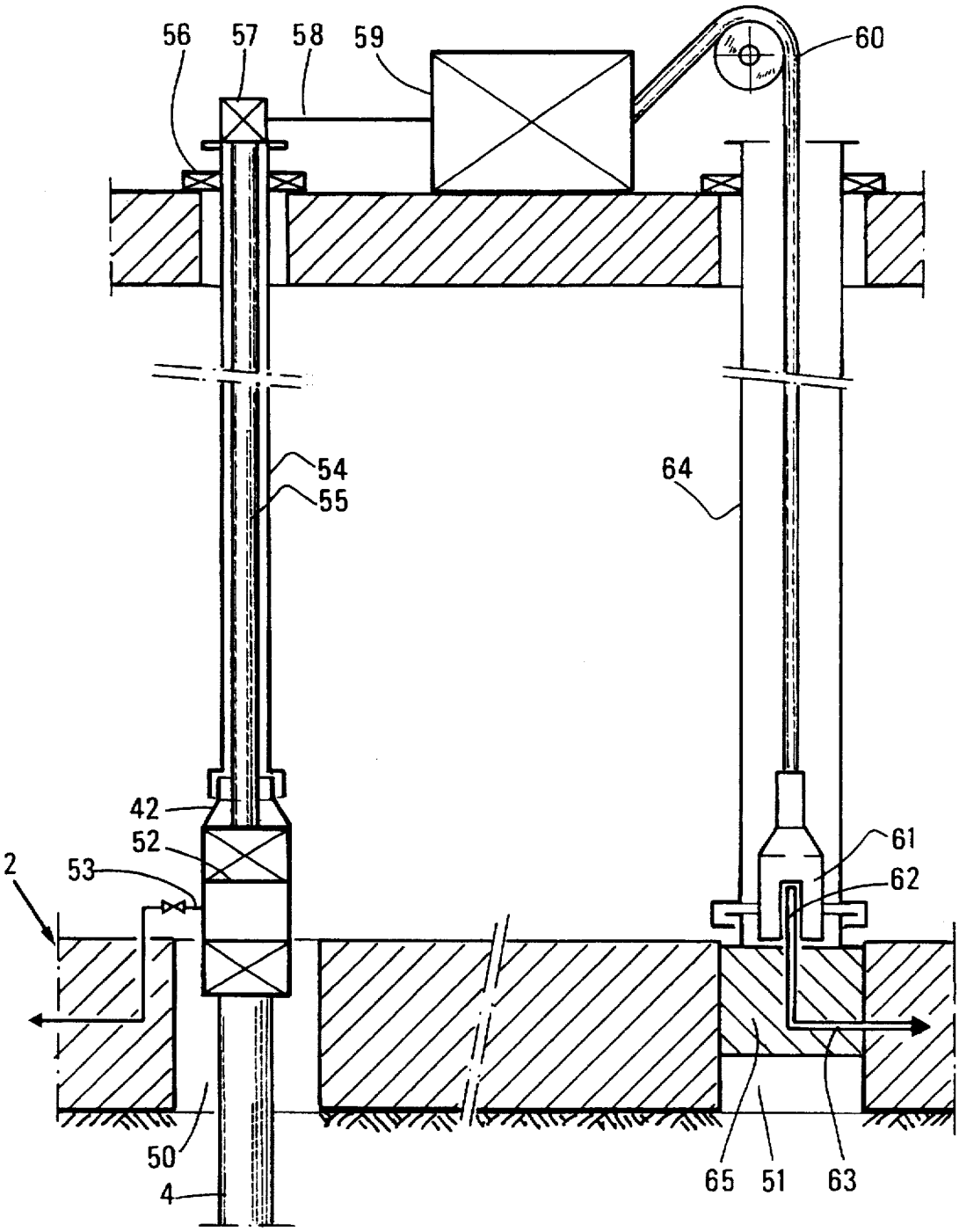

FIG. 4 shows a variant in which two well slots 50 and 51 of the baseplate 2 play a particular part. Slot 50 has been equipped with a wellhead 52 after the drilling of well 4. Connection means 42 fasten the base of a riser 54 suspended from the floor of the platform by support and traction means 56. A production tubing 55 conveys all or part of the gas produced by well 4. In fact, for safety reasons and sometimes because of the pressure or of the corrosive effects of certain gases, it can be preferred to double riser 54 with an inner tubing 55 also suspended from means 56. Insofar as the platform has practically no heave, no compensation means are required for the tubular elements connecting the bottom to the platform. In this case, pipe 53 is connected to the side outlet of a T-shaped sub assembled on tubing 55.

A tubing head 57 and a pipe 58 convey the gas to a power production facility 59. The facility works mainly from the fuel supplied by the gas produced by well 4. Facility 59 can comprise, as it is well-known, a gas turbine and electricity generators that supply power notably to the pumping device, and also to the wellhead controls, the manifold controls, the guide means or the underwater servicing robots. An umbilical 60 runs down to the baseplate 2 inside a riser 64 connecting the platform to a slot 51 free from wells and wellheads, and comprising means 65 for fastening riser 64 and for connection with umbilical 60. A connector 61 is fastened to the base of the umbilical and co-operates with a corresponding part 62 of connector 61, said part being integral with means 65. A line 63 transmits power, commands and measurements to the corresponding elements. The umbilical that can be used here and the means for connecting the umbilical are known in the profession. The implementation of the transmission element in a riser 64 facilitates the protection of the umbilical against the marine environment.

Without departing from the scope of the invention, the pumping device can work mainly with a fluid under pressure. In this case, means 59 include a hydraulic pump that supplies the pumping device 21 with fluid under pressure by means either of a flexible pipe connected like umbilical 60, or directly in the inner space of a riser 64.

The wellhead 52 also comprises a pipe 53 connected to the general distribution manifold. A part of the gas or of the liquids produced can be driven towards the pumping device while a part of the gas is collected through tubing 55. In the case of a multiphase effluent, the side outlet connected to pipe 53 preferably discharges the liquids, whereas the gas runs towards the surface through tubing 55.

Figure 5:
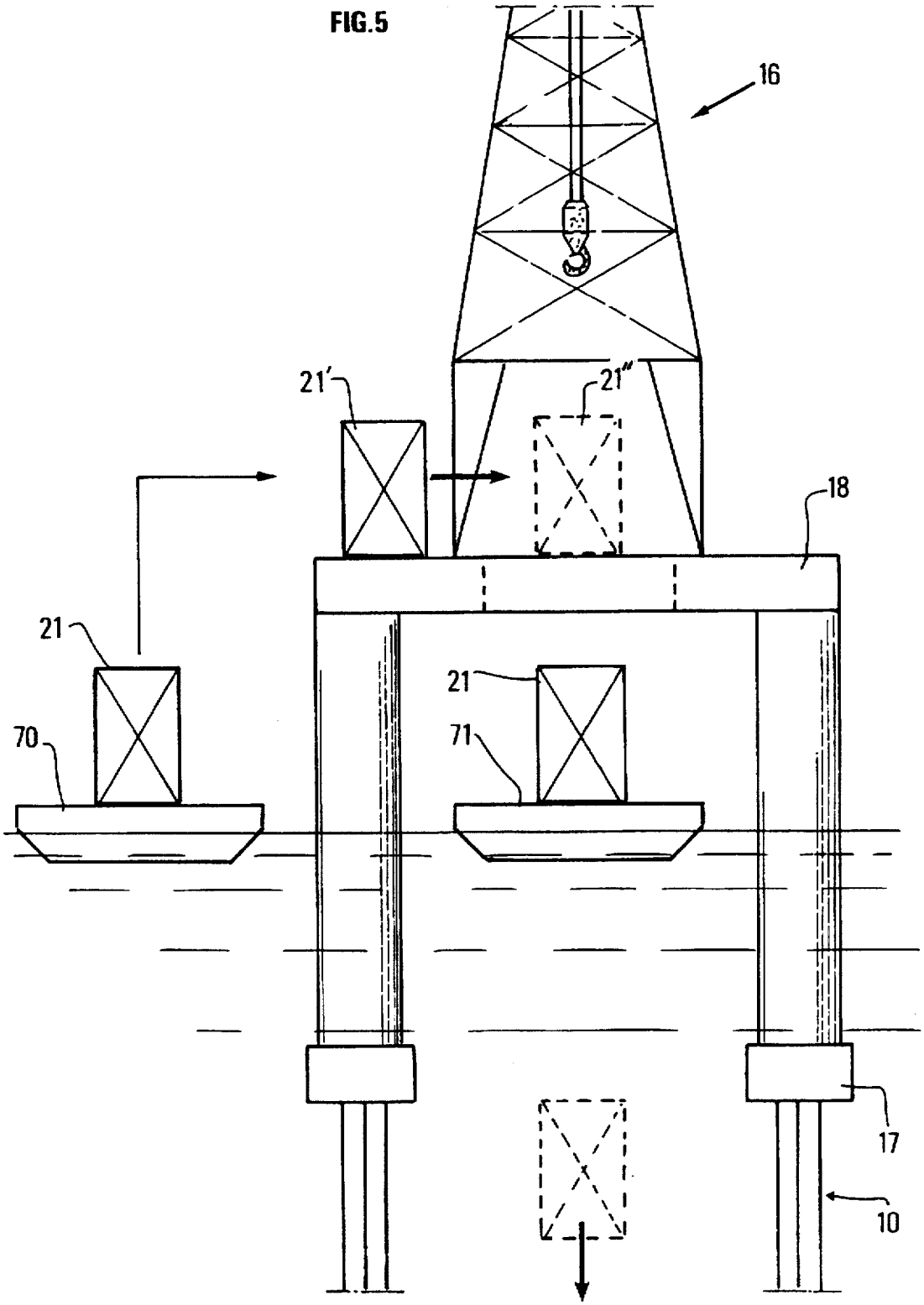
FIG. 5 shows a principle of the operation of setting of a pumping device by means of the hoisting means of the platform.

FIG. 5 shows the platform whose pontoons 17 are held underwater by means of tendons 10. The floor 18 bears the hoisting means 16 used for handling notably the pumping device 21. In a first instance, a barge 70 conveys device 21 to the edge of the platform, and a crane located on the barge, on deck 18 or on another barge, unloads at 21' on deck 18 the caisson forming the pumping device. The auxiliary hoisting facility is light because the pumping device, which represents the heaviest parcel, does not exceed 20 tons in weight, preferably about 15 tons. The pumping device is thereafter slid to 21" in order to be handled by the hoisting means 16.

In another instance, especially when there are no risers cluttering the space between the underwater pontoon and the floor 18, a barge 71 can be placed directly under floor 18 in order to place device 21 straight below the hoisting means 16. The hoisting means thereafter unload the parcel 21 and they can directly handle pumping device 21.

Of course, these operations can relate to the other parcels that can be brought onto floor 18.

I claim:

1. A method for developing offshore oil fields, comprising:

anchoring a baseplate (2) comprising means (11, 12) for fastening tendons (10), subsea wellhead slots (5,6) and pumping device receptacles (22) to a sea bottom, setting a complementary floating support (9) comprising hoisting means (16) substantially straight above said baseplate, fastening tendons (10) to said means for fastening and to said complementary support, and applying a predetermined tension onto said tendons, such that the support and baseplate are connected by said tendons at said tension, lowering at least one pumping device (21) through the water depth by means of said hoisting means (16) and connecting it onto said receptacles, connecting wellheads (7,8) in said wellhead slots to the pumping device by effluents collection and distribution means (25,26), and transferring at least part of the effluents coming from the pumping device through a subsea line (27) without transitting through said support (9).

2. A method as claimed in claim 1, wherein at least one of the wellheads is equipped with a riser (43; 54) running up to the complementary support (9).

3. A method as claimed in claim 1, wherein at least part of the effluent of a well is transferred to the complementary support in order to serve as fuel for a power generation means (59) on the support.

4. A method as claimed in claim 1, wherein a means (64) for transmitting power, measurements and commands between support (9) and the pumping device (21) are placed in a riser (64) connecting the support to a slot (51) free from wellheads.

5. A method as claims in claim 1, further comprising drilling a well from a wellhead slot in said baseplate by a floating drill support.

6. A method as claimed in claim 1, further comprising performing workover operations in producing wells with the aid of means for hoisting said complementary support, said wells being connected to said complementary support by a riser.

7. The method of claim 1, wherein the effluents from the pumping device are transferred through said subsea line to an onshore process or storage facility.

8. The method of claim 1, wherein the tendons are tensioned to about 300 tons.

9. A system for developing offshore oil fields, comprising:

a baseplate (2) anchored to a sea bottom, comprising means (11,12) for fastening tendons (10), subsea wellhead slots (5,6) and pumping device receptacles (22; 32), a complementary floating support (9) placed substantially straight above said baseplate (2), comprising hoisting means (16), tendons (10) fastened to said means for fastening and to said complementary support and tautened by a predetermined value such that the support and baseplate are connected by said tendons at said tension, at least one pumping device (21) suited for being operated through the water depth with the aid of said hoisting means (16) and connected to one of said receptacles (22;32), effluents collection and distribution means (25, 26; 33,34) connecting wellheads in said wellhead slots to the pumping device, subsea transfer means (27) for transferring at least part of the effluents coming from the pumping device without transitting through said support.

10. A system as claimed in claim 9, wherein at least one of the wellheads comprises a riser running up to the complementary support.

11. A system as claimed in claim 9, wherein said complementary support comprises power generation means whose fuel is provided by at least part of a well effluent transferred to the complementary support.

12. A system as claimed in claim 9, wherein a means for transmitting power, measurements and commands between the support and the pumping device are placed in a riser connecting the support to one of said slots free from wellheads.

13. A system as claimed in claim 9, wherein said baseplate has substantially the shape of a regular polygon, said tendon fastening means being located substantially at the vertices of said polygon, said subsea wellhead slots being located substantially between said vertices, and the receptacles of the pumping devices are located substantially in the central part of said polygon.

14. A system as claimed in claim 13, wherein the baseplate and the complementary support have substantially the external shape of a square having sides of about 30 meters.

15. A system as claimed in claim 9, wherein said pumping device comprises a multiphase pump, a motor, a multiphase flow measuring module and a regulation module.

16. The system of claim 9, wherein the subsea transfer means are in communication with an onshore process or storage facility.

17. The system of claim 9, wherein the total weight of the system structure is between 1200 and 3500 tons.

18. The system of claim 9, wherein the tendons are tensioned to about 300 tons.

* * * * *